US011365736B2

(12) United States Patent
Bi et al.

(10) Patent No.: US 11,365,736 B2
(45) Date of Patent: Jun. 21, 2022

(54) SLIDE VALVE, SLIDE VALVE ADJUSTMENT MECHANISM AND SCREW COMPRESSOR

(71) Applicant: Gree Electric Appliances, Inc. of Zhuhai, Guangdong (CN)

(72) Inventors: Yushi Bi, Guangdong (CN); Zhiping Zhang, Guangdong (CN); Zhongkeng Long, Guangdong (CN); Cong Cao, Guangdong (CN); Rihua Li, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 17/261,203

(22) PCT Filed: Dec. 20, 2018

(86) PCT No.: PCT/CN2018/122215
§ 371 (c)(1),
(2) Date: Jan. 19, 2021

(87) PCT Pub. No.: WO2020/034520
PCT Pub. Date: Feb. 20, 2020

(65) Prior Publication Data

US 2021/0270269 A1 Sep. 2, 2021

(30) Foreign Application Priority Data

Aug. 13, 2018 (CN) ..... 201810913935.7

(51) Int. Cl.
*F04C 28/12* (2006.01)
*F04C 18/16* (2006.01)
*F04C 28/26* (2006.01)

(52) U.S. Cl.
CPC ..... *F04C 28/12* (2013.01); *F04C 18/16* (2013.01); *F04C 28/26* (2013.01); *F04C 28/265* (2013.01); *F04C 2210/221* (2013.01)

(58) Field of Classification Search
CPC ..... F04C 18/16; F04C 28/12; F04C 28/26; F04C 28/265; Y10T 137/86759; Y10T 137/86791
See application file for complete search history.

(56) References Cited

U.S. PATENT DOCUMENTS 4,042,310 A * 8/1977 Schibbye ..... F04C 28/125 418/201.2
8,221,104 B2 * 7/2012 Wilson ..... F04C 18/16 418/201.2

(Continued)

FOREIGN PATENT DOCUMENTS

CN 203257684 U 10/2013
CN 103470504 A 12/2013

(Continued)

*Primary Examiner* — Mary Davis
(74) *Attorney, Agent, or Firm* — The Webb Law Firm

(57) ABSTRACT

The present disclosure is related to a slide valve, a slide valve adjustment mechanism and a screw compressor. The slide valve includes a static slide valve and a moving slide valve, wherein the static slide valve is fixedly installed in a slide valve cavity and provided with an axially-penetrating valve hole; a plurality of bypass holes communicating with the valve hole (110) are formed in the sidewall of the static slide valve, and an exhaust port is formed in the sidewall of one end of the static slide valve. The slide valve may avoid scraping between the slide valve and a screw rotor and the slide valve cavity. Gaps between the slide valve and parts which cooperate with same are reduced, so that the leakage is reduced while the energy efficiency of the compressor is increased.

10 Claims, 7 Drawing Sheets

(56) References Cited

U.S. PATENT DOCUMENTS

| | | | | |
|---|---|---|---|---|
| 2017/0030356 | A1 | 2/2017 | Yonemoto et al. | |
| 2020/0291942 | A1* | 9/2020 | Yang | F04C 18/16 |
| 2021/0131434 | A1* | 5/2021 | Broglia | F04C 18/16 |

FOREIGN PATENT DOCUMENTS

| | | | |
|---|---|---|---|
| CN | 103486037 | A | 1/2014 |
| CN | 105805009 | A | 7/2016 |
| CN | 106164490 | A | 11/2016 |
| CN | 108661906 | A | 10/2018 |
| CN | 208669597 | U | 3/2019 |
| WO | 2011048618 | A1 | 4/2011 |

* cited by examiner

SLIDE VALVE, SLIDE VALVE ADJUSTMENT MECHANISM AND SCREW COMPRESSOR

CROSS-REFERENCE TO RELATED APPLICATIONS

This application is the United States national phase of International Application No. PCT/CN2018/122215 filed Dec. 20, 2018, and claims priority to Chinese patent application filed on Aug. 13, 2018, with application number 201810913935.7, titled "SLIDE VALVE, SLIDE VALVE ADJUSTMENT MECHANISM AND SCREW COMPRESSOR", the disclosures of which are hereby incorporated by reference in their entirety.

BACKGROUND OF THE INVENTION

Field of the Invention

The present disclosure is related to a slide valve, a slide valve adjustment mechanism and a screw compressor.

Description of Related Art

The capacity adjustment of a screw compressor is usually completed by means of a capacity adjustment slide valve. Specifically, the slide valve is installed in a slide valve cavity of a screw compressor body, and the slide valve is located at the intersection of the two circles of a female rotor and a male rotor. The slide valve can slide back and forth along the axial direction of the compressor body. With the sliding of the slide valve, the slide valve is separated from the casing of the compressor, and some gases will be bypassed through an opening so as to achieve the purpose of capacity adjustment.

However, during the repeated movement of the slide valve, due to the influence caused by the compressed and exhausted air flow pulsation, there is a risk of scraping between the slide valve and the female rotor, the slide valve and the male rotor, and the slide valve and the slide valve cavity of the body. In order to avoid scraping, a structural design that enlarges the gap between the slide valve and the female rotor, the slide valve and the male rotor, and the slide valve and the slide valve cavity is usually used. As a result, this will also probably lead to a gas leak that reduces the energy efficiency of the compressor.

SUMMARY OF THE INVENTION

A slide valve in accordance with some embodiments comprises: a static slide valve and a moving slide valve, wherein the static slide valve is fixedly installed in a slide valve cavity, and the static slide valve is provided with an axially-penetrating valve hole; a plurality of bypass holes communicating with the valve hole are further formed in the sidewall of the static slide valve, and an exhaust port is further formed in the sidewall of one end of the static slide valve.

The moving slide valve comprises a valve body, and the valve body is slidably arranged in the valve hole; a limiting structure is provided between the static slide valve and the moving slide valve, and the limiting structure limits a limiting position for the sliding of the valve body towards the exhaust port along the valve hole; and the valve body opens all the bypass holes when moving towards the exhaust port to the limiting position, and the valve body sequentially closes all the bypass holes when moving towards a direction away from the exhaust port.

A slide valve adjustment mechanism in accordance with some embodiments comprises the above-mentioned slide valve and a piston assembly, wherein the valve body is connected to the piston assembly.

A screw compressor in accordance with some embodiments comprises a body provided with a slide valve cavity, wherein the screw compressor further comprises the above-mentioned slide valve adjustment mechanism, and the static slide valve is fixedly installed in the slide valve cavity.

DETAILED DESCRIPTION OF THE INVENTION

Figure 1:
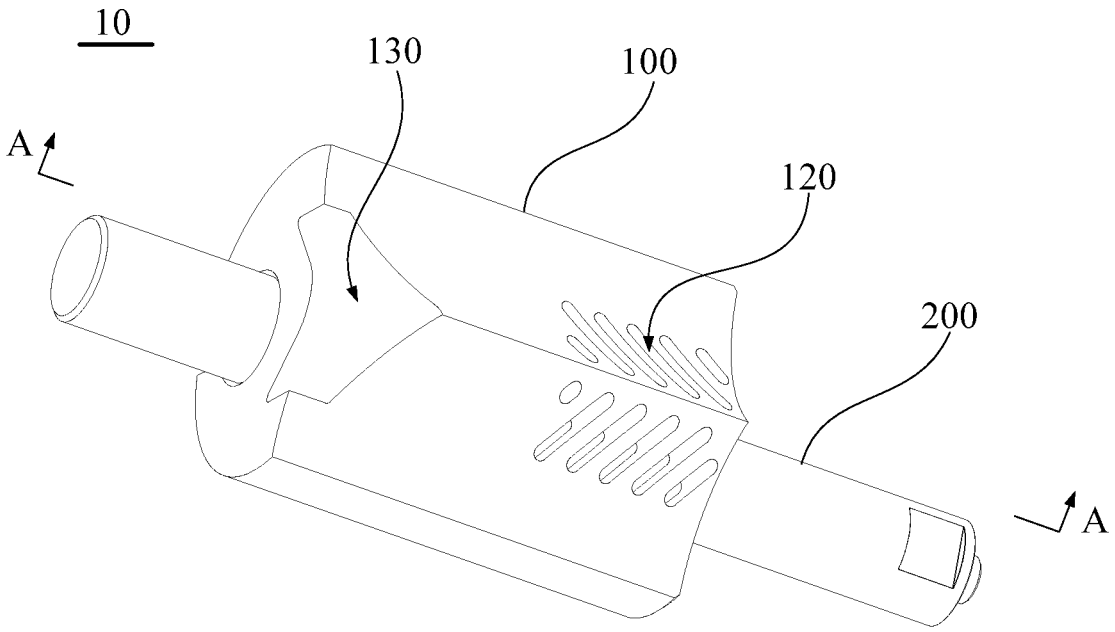
FIG. 1 is a structural schematic diagram of a slide valve provided in some embodiments of the present disclosure.

In order to make the objectives, technical solutions, and advantages of the present disclosure clearer and more comprehensible, the slide valve, the slide valve adjustment mechanism and the screw compressor of the present disclosure will be further illustrated in detail below through embodiments and in conjunction with the accompanying drawings. It should be understood that the specific embodiments described herein are merely used to explain the present disclosure and are not intended to limit the present disclosure.

It should be noted that when one element is referred to as being "fixed to" another element, the element may be directly located on another element or an intervening element may also exist. When one element is considered to be "connected" to another element, the element may be directly connected to another element or an intervening element may exist simultaneously. In contrast, when one element is referred to as being "directly on" another element, there are no intermediate elements. The terms "perpendicular", "horizontal", "left", "right", and the like used herein are merely for the purpose of illustration.

As illustrated in FIGS. 1-4, the slide valve 10 provided in some embodiments of the present disclosure comprises: a static slide valve 100 and a moving slide valve 200, wherein the static slide valve 100 is fixedly installed in a slide valve cavity, and the static slide valve 100 is provided with an axially-penetrating valve hole 110; a plurality of bypass holes 120 communicating with the valve hole 110 are further formed in the sidewall of the static slide valve 100, and an exhaust port 130 is further formed in the sidewall of one end of the static slide valve 100.

The moving slide valve 200 comprises a valve body 210, and the valve body 210 is slidably arranged in the valve hole 110; a limiting structure 300 is provided between the static slide valve 100 and the moving slide valve 200, and the limiting structure 300 limits a limiting position for the sliding of the valve body 210 towards the exhaust port 130 along the valve hole 110; and the valve body 210 opens all the bypass holes 120 while moving towards the exhaust port 130 to the limiting position, and the valve body 210 sequentially closes all the bypass holes 120 while moving towards a direction away from the exhaust port 130.

The static slide valve 100 is fixedly installed in the slide valve cavity of the compressor body 30, and the static slide valve 100 cooperates with a compressor rotor to play a sealing role, thus ensuring the sealing performance of the compressor. The moving slide valve 200 is a moving component, and the valve body 210 of the moving slide valve 200 can reciprocate in the valve hole 110 of the static slide valve 100, which can achieve the purpose of adjusting the capacity of the compressor. Since the static slide valve 100 does not move and the moving slide valve 200 is not in direct contact with the compressor rotor and the slide valve cavity, the problem of scraping between the slide valve 10 and the rotor and the slide valve cavity can be completely solved, and the reliability of the compressor can be improved. And when the slide valve 10 is designed to cooperate with the rotor and the slide valve cavity, the gap between the static slide valve 100 and the rotor, and the gap between the static slide valve 100 and the slide valve cavity can be controlled within a small range, thereby improving the sealing performance of the compressor and increasing the energy efficiency of the compressor.

Figure 5:
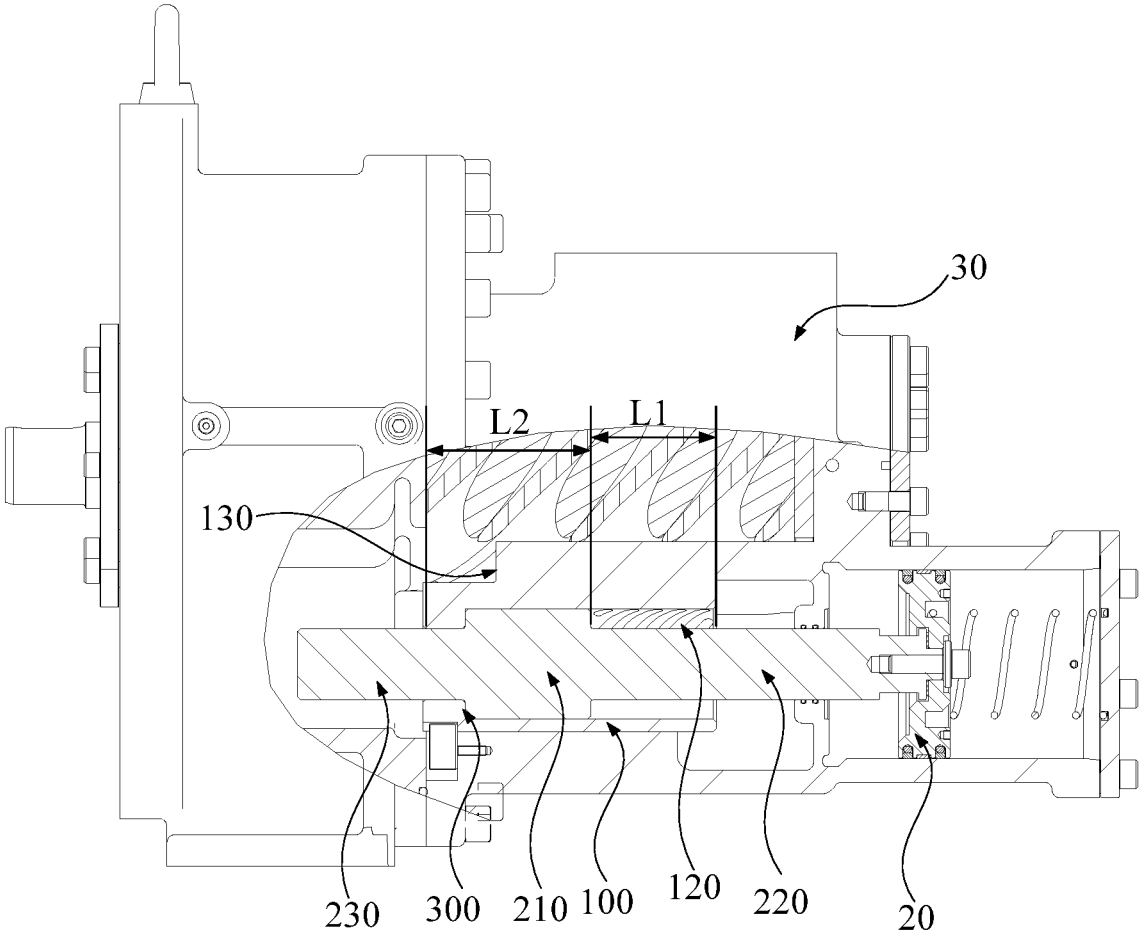
FIG. 5 is a first state schematic diagram of the slide valve illustrated in FIG. 1 applied to the capacity adjustment of the compressor.

In addition, the limiting structure 300 defines a limiting position for the sliding of the valve body 210 along the valve hole 110, that is, defines the distance of the sliding of the valve body 210 along the valve hole 110, which can ensure the positioning of the moving slide valve 200 and prevent the valve body 210 from sliding out of the valve hole 110. As illustrated in FIG. 5, when the slide valve 10 is specifically used in a compressor, one end of the valve body 210 is connected to and cooperates with a piston assembly 20, and the valve body 210 is defined by the limiting structure 300, and the stroke of the valve body 210 is limited by the limiting structure 300 and the structure of the piston assembly 20, which is conducive to the miniaturization design of the compressor.

The limiting structure 300 limits a limiting position for the sliding of the valve body 210 towards the exhaust port 130 along the valve hole 110. It can be understood that the limiting position refers to a position where the valve body 210 moves towards the exhaust port 130 to a position where it cannot continue to move towards the exhaust port 130. The valve body 210 opens all the bypass holes 120 while moving towards the exhaust port 130 to the limiting position, which is also the start position of the compressor at the minimum load. FIG. 5 shows the minimum load state of the compressor. In this way, the start position of the compressor at the minimum load can be changed by adjusting the above-mentioned limiting position, which is beneficial to realize the start of the compressor at a low load. For example, as illustrated in FIG. 5, the limiting structure 300 is a structure that can abut against one end of the valve body 210 close to the exhaust port 130. On the premise that the structural length of the slide valve 10 is not lengthened, the end face (the above-mentioned limiting position) of the limiting structure 300 that is abutting against the valve body 210 is moved to the left by a certain distance, and the valve body 210 can correspondingly move to the left by a greater distance, thereby correspondingly increasing the bypass area around the bypass holes 120 while decreasing the minimum load value of the compressor, which is beneficial to the start of the compressor at a lower load.

Figure 6:
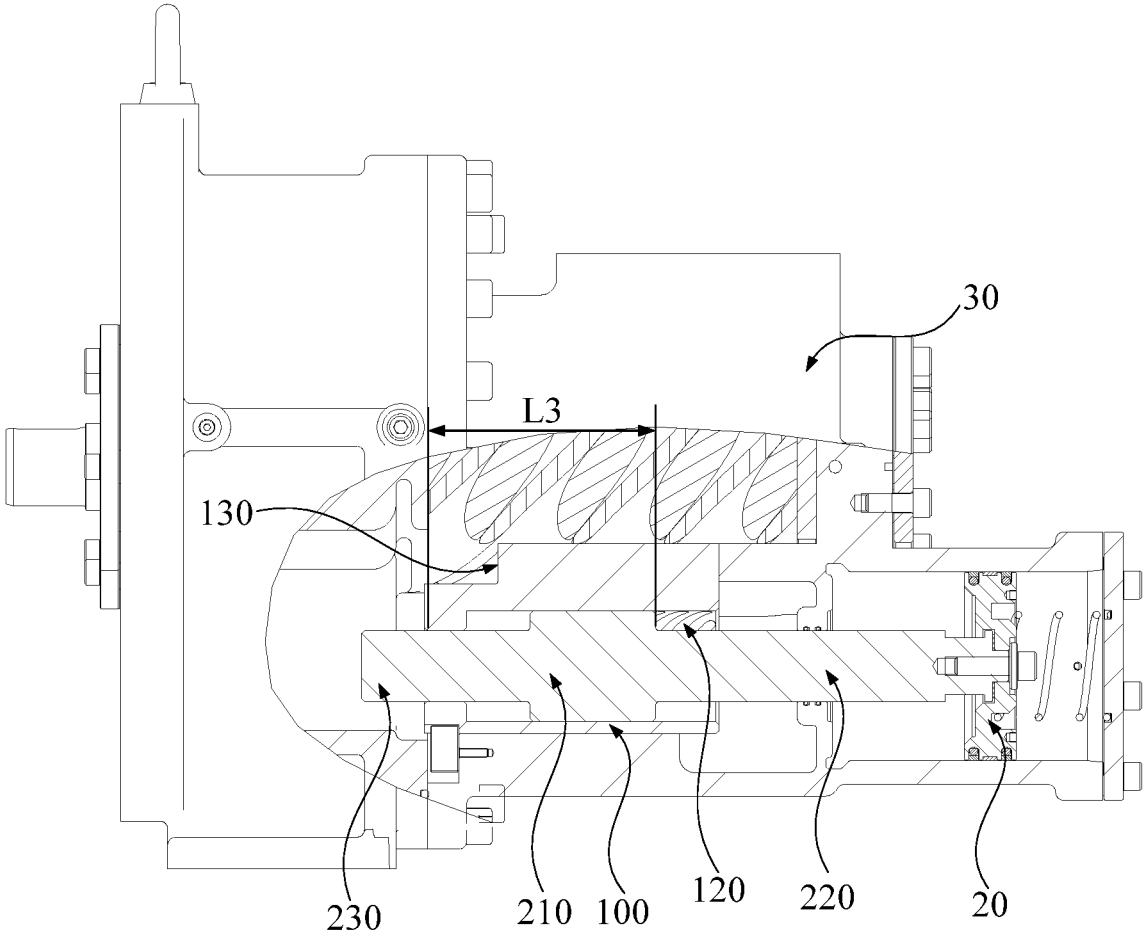
FIG. 6 is a second state schematic diagram of the slide valve illustrated in FIG. 1 applied to the capacity adjustment of the compressor.
Figure 7:
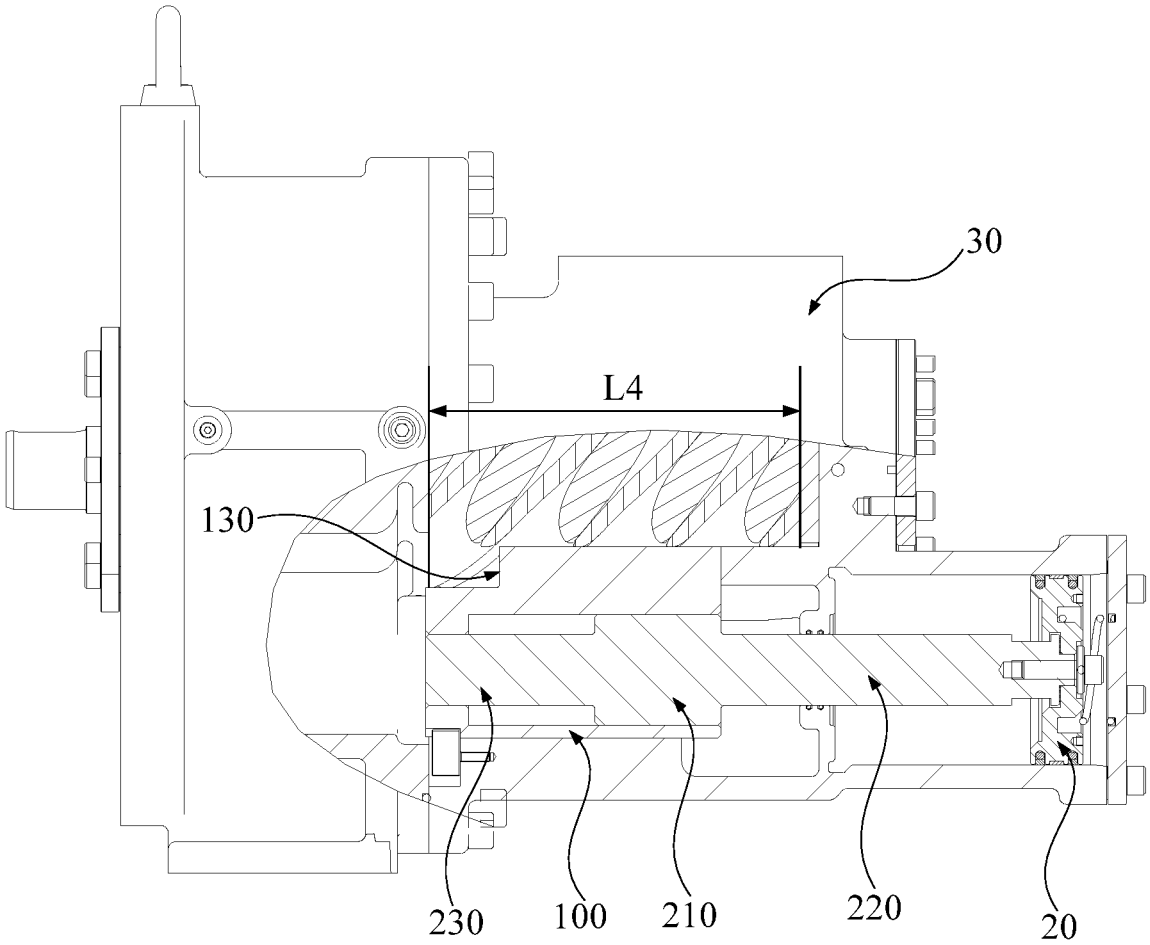
FIG. 7 is a third state schematic diagram of the slide valve illustrated in FIG. 1 applied to the capacity adjustment of the compressor.

As the compressor is loaded, the valve body 210 moves towards a direction away from the exhaust port 130, and the valve body 210 sequentially closes all the bypass holes 120. FIG. 6 shows that the compressor is in an intermediate state, at this time the valve body 210 closes some of the bypass holes 120. FIG. 7 shows that the compressor is in a full load state. At this time, the valve body 210 closes all the bypass holes 120, and the compressor is in a full load state. As a result, the valve body 210 reciprocates in the valve hole 110, so that the compressor can perform operation at different loads to adjust capacity.

As illustrated in FIGS. 2 and 5-7, in some embodiments, the exhaust port 130 is a right-angled groove provided in an outer sidewall of the static slide valve 100, and the exhaust port 130 and the valve hole 110 are isolated from each other. The exhaust port 130 is provided on the outer sidewall of the static slide valve 100; and since the static slide valve 100 is fixed, the position of the exhaust port 130 is also fixed. In addition, the exhaust port 130 and the valve hole 110 are isolated from each other, that is, the two do not communicate with each other. Therefore, the size of the exhaust port 130 will remain unchanged during the reciprocating of the moving slide valve 200 relative to the static slide valve 100. Therefore, the compressor can exhaust according to the constant-sized exhaust port 130 at a fixed position, which can facilitate the constant internal pressure ratio of the compressor during the load adjustment process and solve the problem of overcompression.

Figure 2:
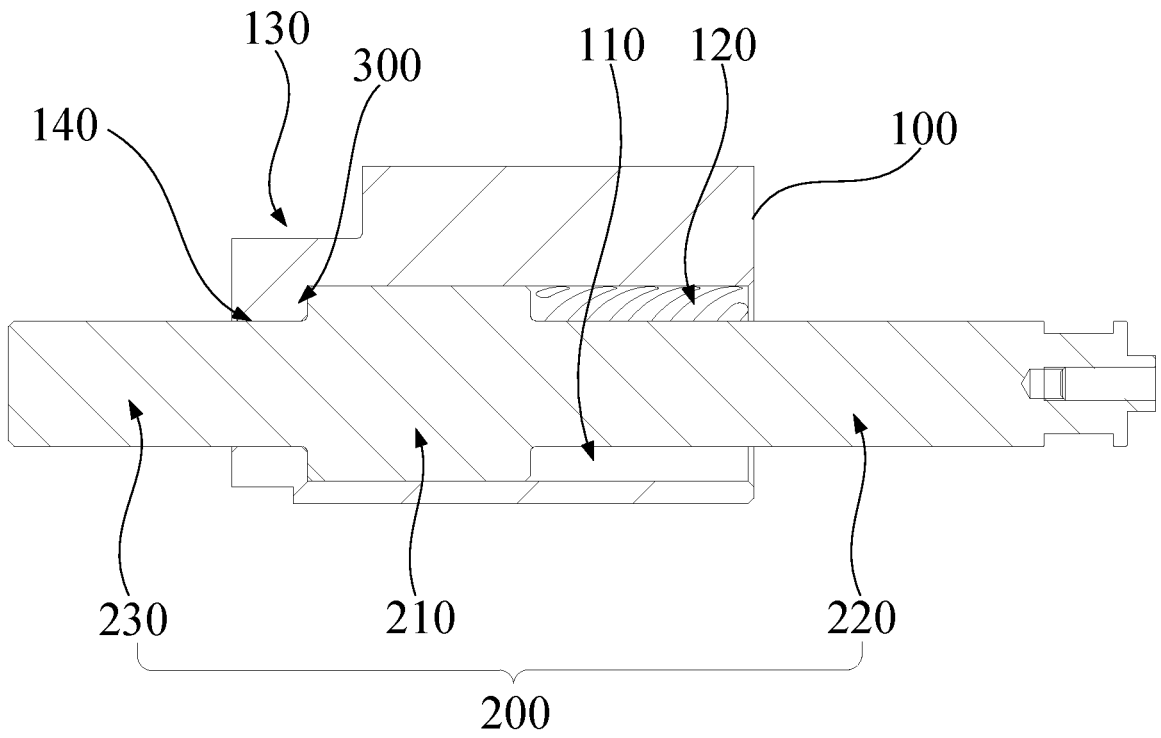
FIG. 2 is a cross-sectional schematic view, along A-A direction, of the structure illustrated in FIG. 1.
Figure 3:
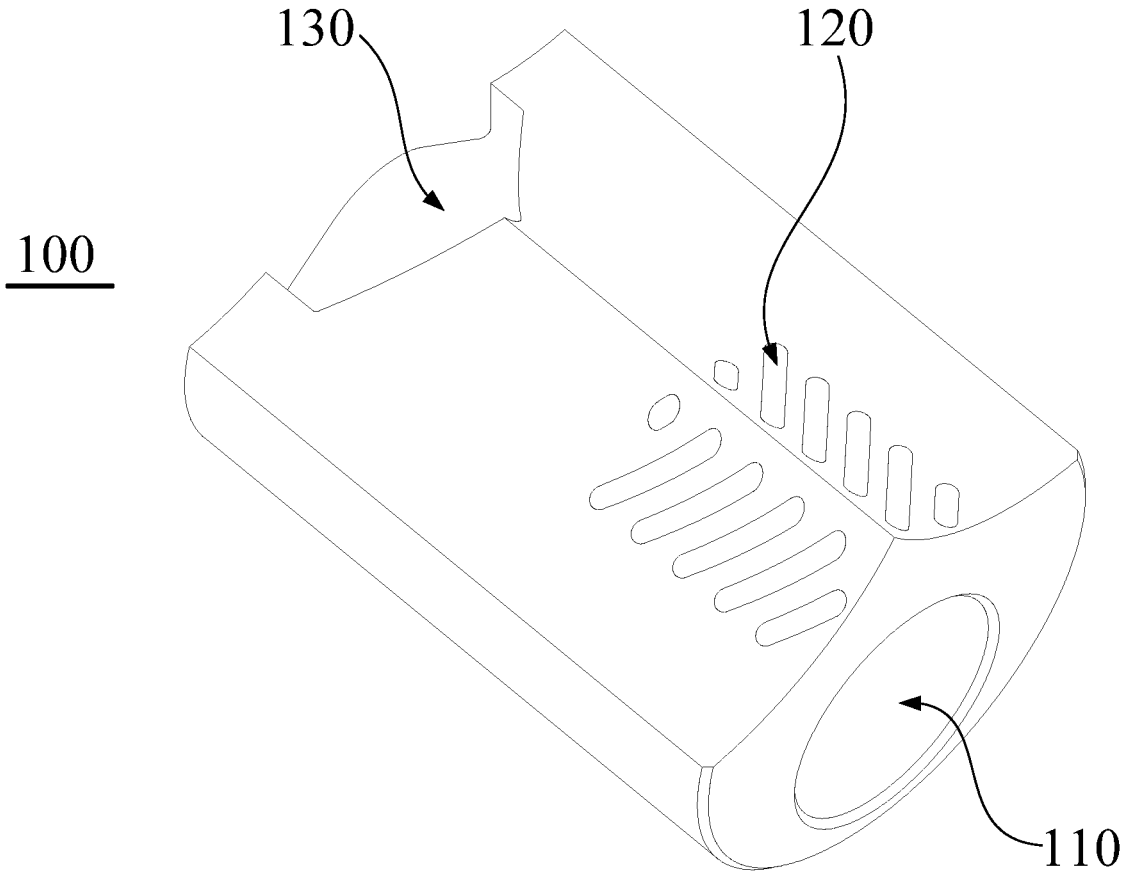
FIG. 3 is a structural schematic diagram of a static slide valve in the structure illustrated in FIG. 1.

As illustrated in FIGS. 1 and 2, in some embodiments, along the axial direction of the static slide valve 100, the length of the valve body 210 is greater than the length of the plurality of bypass holes 120. Such a design can ensure that the valve body 210 can completely seal all the bypass holes 120 when the compressor is at full load state, and avoid leakage. It can be understood that the length of the valve body 210 only needs to be slightly greater than the length of the plurality of bypass holes 120 to reduce the weight of the slide valve. Alternatively, the valve hole 110 may be a circular hole, and the cross section of the valve body 210 is circular.

As illustrated in FIGS. 1 and 2, in some embodiments, along the axial direction of the static slide valve 100, the sum of the length of the valve body 210 and the length of the plurality of bypass holes 120 is smaller than the length of the valve hole 110. Such a design can ensure that the valve body 210 is not in contact with any bypass hole 120 when the compressor is in the minimum load state, that is, when the valve body 210 moves towards the exhaust port 130 to the limiting position. As a result, it is ensured that all the bypass holes 120 are in an open state, so that the minimum load through the slide valve bypass design is consistent with the actual minimum load of the compressor. Otherwise, assuming that the valve body 210 is in contact with a certain bypass hole 120 when the compressor is in the minimum load state, theoretically the minimum load through the slide valve bypass design is not the actual minimum load of the compressor. Since the bypass holes 120 are not fully opened, the minimum load through the slide valve bypass design is relatively larger.

The limiting structure 300 can be in various structural forms. In some embodiments, the limiting structure 300 comprises a protrusion provided on the sidewall of the static slide valve 100, and the protrusion protrudes out of the hole wall of the valve hole 110 along the radial direction of the static slide valve 100, and the protrusion can abut against one end of the valve body 210 close to the exhaust port 130. The valve body 210 is limited by providing a protrusion on the static slide valve 100, whose structure is simple and easy to implement, and no additional spare parts are needed, which facilitates the simplification of the structure. It can be understood that, as illustrated in FIG. 2, the protrusion may be in an annular shape, and the annular-shaped protrusion is provided on the sidewall of one end of the static slide valve 100. Alternatively, there may be two or more protrusions that may be evenly distributed on the sidewall of one end of the static slide valve 100 along the circumferential direction of the valve hole 110. In other embodiments, the limiting structure 300 may also be a baffle, which is provided at one end of the static slide valve 100, and the baffle may partially cover the valve hole 110, as long as the valve body 210 cannot slide out of the valve body 210.

Alternatively, in some embodiments, the limiting structure 300 may be a baffle ring provided on the moving slide valve 200, and the baffle ring is sleeved on one end of the moving slide valve 200 away from the exhaust port 130. The baffle ring can abut against one end of the static slide valve 100 away from the exhaust port 130 to define the moving distance of the valve body 210 towards the exhaust port 130. When the valve body 210 moves towards the exhaust port 130 to the limiting position, the baffle ring abuts against the end of the static slide valve 100 away from the exhaust port 130.

In some embodiments, the moving slide valve 200 further comprises a connection portion 220 connected to one end of the valve body 210 away from the exhaust port 130, and the connection portion 220 is connected to the piston assembly 20. It can be understood that the connection portion 220 may be of a rod-shaped structure, or of a plate-shaped structure, or the like. By providing the connection portion 220, the connection to the piston assembly 20 can be facilitated, and the movement of the valve body 210 can be guided, and the movement smoothness of the valve body 210 can be improved. In addition, as mentioned above, the stroke of the valve body 210 is limited by the limiting structure 300 and the structure of the piston assembly 20. The connection portion 220 is connected to one end of the valve body 210 away from the exhaust port 130. The connection portion 220 connects the valve body 210 and the piston assembly 20. During the reciprocating of the moving slide valve 200, part of the movement of the connection portion 220 is located within the stroke range of the valve hole 210. As a result, the axial volume of the compressor can be reduced, which is conducive to the miniaturization design of the compressor.

Figure 4:
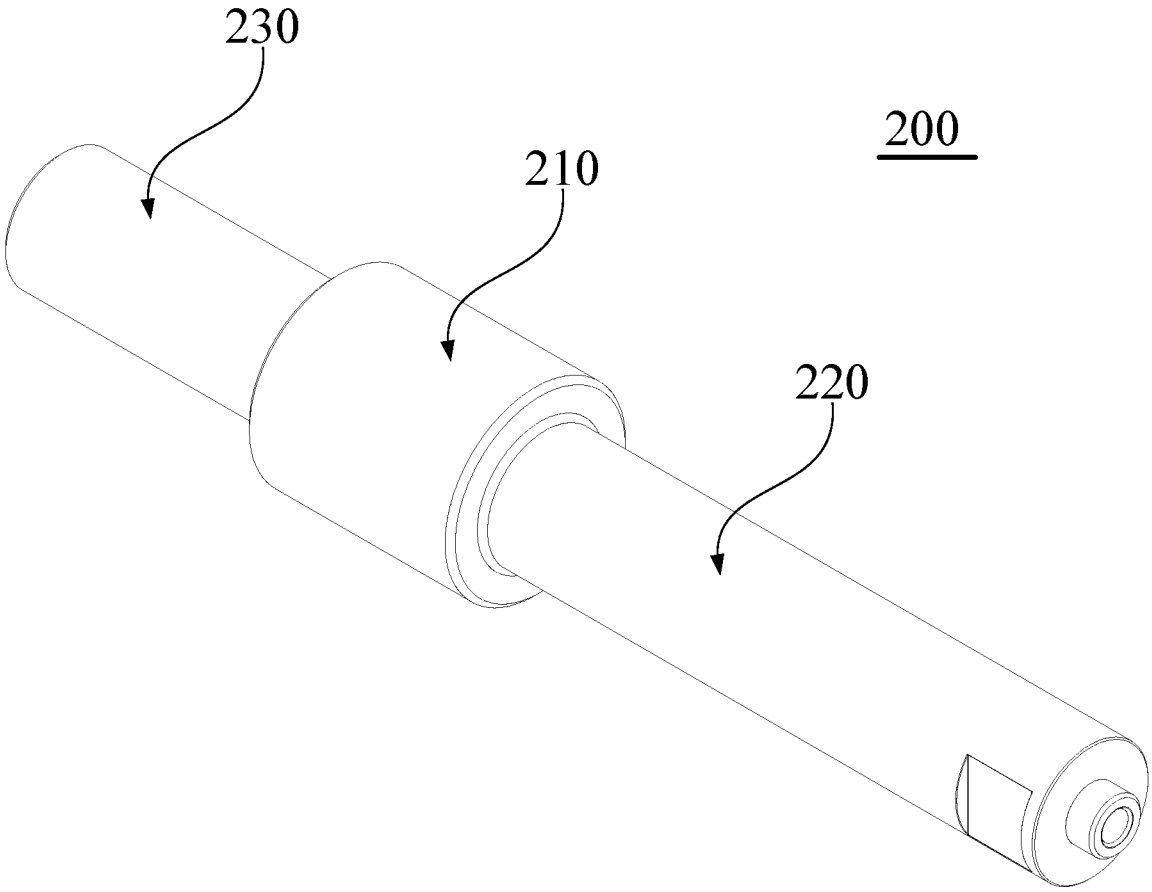
FIG. 4 is a structural schematic diagram of a moving slide valve in the structure illustrated in FIG. 1.

As illustrated in FIGS. 2 and 4, in some embodiments, the moving slide valve 200 further comprises a guide portion 230 connected to one end of the valve body 210 away from the connection portion 220, and one end of the static slide valve 100 is further provided with a guide hole 140 for the guide portion 230 to be provided in a penetrating manner. It can be understood that the guide portion 230 may be of a rod-shaped structure, or of a plate-shaped structure, or the like. By providing the guide portion 230, the sliding of the valve body 210 can be guided. The guide portion 230 and the connection portion 220 are respectively located at both ends of the valve body 210, so that the valve body 210 can move smoothly in the valve hole 110, which improves reliability.

It can be understood that the guide hole 140 is for the guide portion 230 to be provided in a penetrating manner, so as to guide the sliding of the valve body 210, and the cross-sectional shape of the guide hole 140 should be adapted to the cross-sectional shape of the guide portion 230. The guide hole 140 may be a circular hole, and the cross section of the guide portion 230 is circular.

In some embodiments, the limiting structure 300 is arranged at one end of the static slide valve 100 close to the exhaust port 130, and the guide hole 140 is provided in the limiting structure 300. In these embodiments, the guide hole 140 and the limiting structure 300 are integrated on the same structure of the static slide valve 100. For example, as illustrated in FIG. 2, the center of the end face at one end of the static slide valve 100 is provided with a guide hole 140 for the guide portion 230 to be provided in a penetrating manner, and the cross-sectional area of the guide hole 140 is smaller than the cross-sectional area of the valve hole 110. The part of the end face of the static slide valve 100 excluding the guide hole 140 is the limiting structure 300 that can define the limiting position of the sliding of the valve body 210. This design greatly simplifies the structure of the slide valve 10. The static slide valve 100 in these embodiments not only defines the limiting position of the valve body 210 sliding towards the side of the exhaust port 130, but also can guide the sliding of the valve body 210.

In some embodiments, along the axial direction of the static slide valve 100, the sum of the length of the guide portion 230 and the length of the valve body 210 is greater than or equal to the sum of the length of the guide hole 140 and the length of the valve hole 110. Through such a design, it can be ensured that the end portion of the guide portion 230 can be flush with the end portion of the static slide valve 100 when the compressor is at a full load state. Alternatively, the end portion of the guide portion 230 can slightly protrude out of the end portion of the static slide valve 100. Therefore, it can be ensured that the guide portion 230 can always be in the guide hole 140 to guide the movement of the valve body 210.

As illustrated in FIG. 5, a slide valve adjustment mechanism provided in some embodiments of the present disclosure comprises a slide valve and a piston assembly 20. The slide valve is the slide valve 10 of any of the above embodiments, and the valve body 210 is connected to the piston assembly 20. Since the slide valve 10 has the above-mentioned beneficial effects, the slide valve adjustment mechanism also has corresponding beneficial effects, which will not be repeated here.

As illustrated in FIGS. 5-7, a screw compressor provided in some embodiments of the present disclosure comprises a body 30 provided with a slide valve cavity. The screw compressor further comprises the slide valve adjustment mechanism in the above-mentioned embodiments, and the static slide valve 100 is fixedly installed in the slide valve cavity. In some embodiments, the screw compressor is a single screw compressor or a twin-screw compressor.

Taking a twin-screw compressor as an example, the body 30 is provided with a slide valve cavity for the fixed installation of the static slide valve 100. The body 30 is also provided with a male rotor cavity and a female rotor cavity, and a male rotor is rotatably arranged in the male rotor cavity and a female rotor is rotatably arranged in the female rotor cavity. The static slide valve 100 is located at the intersection of the two circles of the female and male rotors. It can be understood that the static slide valve 100 respectively has a surface fitted with the slide valve cavity, a surface fitted with the male rotor, and a surface fitted the female rotor. In some embodiments, the plurality of bypass holes 120 in the static slide valve 100 are provided in the surface where the static slide valve 100 fits with at least one of the male rotor or the female rotor, as required. The shape and arrangement of the bypass holes 120 can be designed as required.

The static slide valve 100 can be fixedly installed in the slide valve cavity in various ways. For example, one end of a positioning key of the slide valve is inserted into the static slide valve 100 and the other end is inserted into the cavity wall of the slide valve cavity to fix the static slide valve 100 and to ensure that the static slide valve 100 cannot move in either the axial direction or the circumferential direction. After the static slide valve 100 is fixedly installed in the slide valve cavity, the moving slide valve 200 is installed in the valve hole 110 of the static slide valve 100, and the valve body 210 is connected to the piston assembly 20 to form a slide valve adjustment mechanism.

As illustrated in FIG. 5, it is the initial position of the slide valve adjustment mechanism before the compressor is powered on to perform operation. The valve body 210 is located at the limiting position close to the exhaust port 130, the valve body 210 and all the bypass holes 120 are not in contact, and the slide valve 10 is in a completely bypass state. The length of a bypass section is L1, that is, the compressor is in the minimum load state. At this time, the effective compression length of a screw rotor is L2. As illustrated in FIG. 6, the compressor is powered on and loaded, the valve body 210 moves to the right to the state illustrated in FIG. 6, and the valve body 210 and the bypass holes 120 have been in partial contact, which reduces the bypass section L1. Correspondingly, the effective compression length of the screw rotor is increased from L2 to L3, that is, the compressor is in an intermediate load state. As illustrated in FIG. 7, the compressor is fully loaded, the valve body 210 and the bypass holes 120 have all been in contact, the bypass section L1=0, and the slide valve is completely sealed. At this time, the effective compression length of the screw rotor increases to L4 (that is, the length of the screw rotor), and the compressor is in a full load state.

During the entire capacity adjustment process, the static slide valve 100 does not perform action, thereby ensuring that the compressor can normally exhaust through the exhaust port 130 under any load without overcompression. At the same time, the problem of scraping between the screw rotor and the slide valve 10 and between the slide valve 10 and the slide valve cavity during the operation process of the compressor can be avoided, ensuring the operation reliability of the compressor. At the same time, the gap between the slide valve 10 and the parts cooperated therewith can be reduced, so that the leakage is reduced while the energy efficiency of the compressor is increased.

The technical features of the above-described examples may be combined arbitrarily. For simplicity in description, all the possible combinations of the technical features in the above-described examples are not described. However, as long as there is no contradiction among the combinations of these technical features, they shall all fall within the scope of the present disclosure.

The above-mentioned examples merely represent several examples of the present disclosure, giving specifics and details thereof, but should not be understood as limiting the scope of the present patent of disclosure thereby. It should be noted that a person of ordinary skill in the art could also make several alterations and improvements without departing from the spirit of the present disclosure and these would all fall within the scope of protection of the present disclosure. Therefore, the scope of protection of the present patent of disclosure shall be in accordance with the appended claims.

The invention claimed is:

1. A slide valve, comprising a static slide valve and a moving slide valve, wherein the static slide valve is fixedly installed in a slide valve cavity, and the static slide valve is provided with an axially-penetrating valve hole;

wherein a plurality of bypass holes communicating with the valve hole are formed in the sidewall of the static slide valve, an exhaust port is formed in the sidewall of one end of the static slide valve; and the moving slide valve comprises a valve body, and the valve body is slidably arranged in the valve hole;

wherein a limiting structure is provided between the static slide valve and the moving slide valve, and the limiting structure limits a limiting position for the sliding of the valve body towards the exhaust port along the valve hole;

wherein the valve body opens all of the plurality of bypass holes when moving towards the exhaust port to the limiting position, and the valve body sequentially closes all of the plurality of bypass holes when moving towards a direction away from the exhaust port, and wherein the exhaust port is a right-angled groove provided in an outer sidewall of the static slide valve, and the exhaust port and the valve hole are isolated from each other.

2. The slide valve according to claim 1, wherein the limiting structure comprises a protrusion provided on the sidewall of the static slide valve, and the protrusion protrudes out of the hole wall of the valve hole along the radial direction of the static slide valve, and the protrusion abuts against one end of the valve body close to the exhaust port.

3. The slide valve according to claim 1, wherein the moving slide valve comprises a connection portion connected to one end of the valve body away from the exhaust port, and the connection portion is connected to a piston assembly.

4. The slide valve according to claim 3, wherein the moving slide valve further comprises a guide portion connected to one end of the valve body away from the connection portion, and one end of the static slide valve is provided with a guide hole for the guide portion to pass through.

5. The slide valve according to claim 4, wherein the limiting structure is arranged at one end of the static slide valve close to the exhaust port, and the guide hole is provided in the limiting structure.

6. The slide valve according to claim 4, wherein along an axial direction of the static slide valve, a sum of a length of the guide portion and a length of the valve body is greater than or equal to a sum of a length of the guide hole and a length of the valve hole.

7. The slide valve according to claim 1, wherein along an axial direction of the static slide valve, a length of the valve body is greater than a length of the plurality of bypass holes.

8. The slide valve according to claim 1, wherein along an axial direction of the static slide valve, a sum of a length of the valve body and a length of the plurality of bypass holes is smaller than a length of the valve hole.

9. A slide valve adjustment mechanism, comprising the slide valve according to claim 1 and a piston assembly, wherein the valve body is connected to the piston assembly.

10. A screw compressor, comprising a body provided with a slide valve cavity, wherein the screw compressor comprises the slide valve adjustment mechanism according to claim 9, and the static slide valve is fixedly installed in the slide valve cavity.

* * * * *